US006946631B2

(12) United States Patent
Braunisch et al.

(10) Patent No.: US 6,946,631 B2
(45) Date of Patent: Sep. 20, 2005

(54) MICROWAVE OVEN HAVING A BROWNING DEVICE

(75) Inventors: Eckart Braunisch, Kimstad (SE); Gunnar Nyren, Norrkoping (SE)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 10/853,919

(22) Filed: May 26, 2004

(65) Prior Publication Data

US 2004/0238532 A1 Dec. 2, 2004

(30) Foreign Application Priority Data

May 27, 2003 (SE) ..... 0301544

(51) Int. Cl.[7] ..... H05B 6/64

(52) U.S. Cl. ..... 219/685; 219/399; 219/405; 219/756; 219/681

(58) Field of Search ..... 219/685, 746, 219/738, 759, 405, 411, 756, 681, 729, 728, 754, 399, 417, 702, 704, 710, 719, 720, 395, 397; 99/325, 451

(56) References Cited

U.S. PATENT DOCUMENTS

| | | | | |
|---|---|---|---|---|
| 4,486,639 A | * | 12/1984 | Mittelsteadt | 219/685 |
| 4,771,154 A | * | 9/1988 | Bell et al. | 219/685 |
| 5,136,133 A | * | 8/1992 | Briggs et al. | 219/756 |
| 6,448,540 B1 | * | 9/2002 | Braunisch et al. | 219/685 |
| 6,528,772 B1 | * | 3/2003 | Graves et al. | 219/680 |

* cited by examiner

*Primary Examiner*—Quang T. Van
(74) *Attorney, Agent, or Firm*—John F. Colligan; Robert O. Rice; Stephen Krefman

(57) ABSTRACT

A browning device for use in a microwave oven. The browning device can include an infrared generator for generating infrared radiation. The browning device being formed such that it has a hollow space. The interior surface of the hollow space facing the microwave oven cavity having an infrared absorbing material for absorbing infrared radiation from an infrared generator. The infrared absorbing material is constructed such that it is able to reach a temperature of 500° C. at which soot is vaporized or ignited. Quartz tubes may be utilized as the infrared generator.

20 Claims, 5 Drawing Sheets

MICROWAVE OVEN HAVING A BROWNING DEVICE

BACKGROUND OF THE INVENTION

1. Field of the Invention

The present invention relates to a microwave oven having a browning device. In particular, the present invention relates to a microwave oven having a browning device comprising a grill element that is arranged to radiate infrared radiation towards a foodstuff placed in the oven.

2. Description of the Related Art

In microwave ovens, browning devices of various kinds are often incorporated in order to allow cooking or heating of food in such a way that a crusty surface is obtained on the foodstuff, i.e. such that a browning effect is achieved. Radiant heat is produced by a tube radiating infrared (IR) radiation (e.g. a quartz tube). The infrared radiation (the thermal exposure) falling on the foodstuff is, in some prior art ovens, increased by means of a reflector that is arranged above/behind the radiating tube.

One problem encountered in connection with this kind of browning devices is that the reflector eventually becomes contaminated by splashes from food and the like during cooking, such that the aesthetic appearance of the browning device gets unpleasant and the reflectivity is lowered, leading to decreased browning performance. Hence, both from a technical point of view, and from a commercial point of view, this is problematic.

EP 0 956 739 discloses a microwave oven having a grilling device that is arranged in a hollow space in the ceiling of the oven cavity. The hollow space is designed so that it is essentially free of microwave radiation, and has a connection opening to the oven cavity. The hollow space has walls that are designed to reflect IR radiation and direct said radiation into the oven cavity. A grate is arranged in the area of the connection opening, the grate consisting of a metal sheet having a number of slots. The grate can be arranged to absorb some of the IR radiation from the grilling device in order to provide a high temperature zone. In this way, the temperature of the grate is said to be increased such that splashes from a foodstuff placed in the oven cavity are burnt at the grate, thus preventing contamination of the reflective interior walls of the hollow space.

A hollow space in any wall of a microwave cavity can be designed so that it is essentially microwave free, as disclosed, for example, in EP 0 573 750.

However, the use of a grate as disclosed in EP 0 956 739 leads to lowering of the amount of infrared radiation reaching the foodstuff in the oven cavity, thus reducing the browning efficiency.

Moreover, there is still a considerable risk of contamination of the reflective surface behind the grilling device. Once contamination has reached and stuck to the reflective surface, it is very difficult to make it clean and revive the reflective properties.

Hence, there is a need for new and improved browning devices for which these problems are eliminated.

SUMMARY OF THE INVENTION

Therefore, it is an object of the present invention to solve the above-mentioned problems by providing a microwave oven having a browning device which increases the infrared exposure of foodstuff placed in the oven cavity and at the same time helps eliminate the problems of contamination caused by splashes and fumes from foodstuff placed in the oven cavity.

In one aspect, the present invention relates to browning device in a microwave oven having an infrared absorbing screen for absorbing infrared emissions from a infrared generator, wherein the infrared absorbing screen is held between a plurality of side walls. The infrared absorbing screen and the plurality of side walls define a hollow space. Also included is an insulation layer at least partially surrounding the infrared absorbing screen. The insulation layer is surrounded by an outer wall which is attached to the side walls. The infrared absorbing screen may be constructed such that it can repeatedly obtain and sustain a temperature of at least 500° C.

In another embodiment, the present invention relates to browning device having an undulated infrared absorbing screen held between a plurality of side walls. The undulated infrared absorbing screen and the plurality of side walls define a first hollow space, and a second hollow space. A first infrared generator is at least partially arranged in the first hollow space. A second infrared generator is at least partially arranged in the second hollow space. The undulated infrared absorbing screen is at least partially surrounded by an insulation layer. An outer wall is arranged around the insulation layer and attached to the side walls.

BRIEF DESCRIPTION OF THE DRAWINGS

The various features and advantages of the present invention will be more fully appreciated when the following detailed description is read in conjunction with the accompanying drawings, in which.

DETAILED DESCRIPTION

Figure 1:
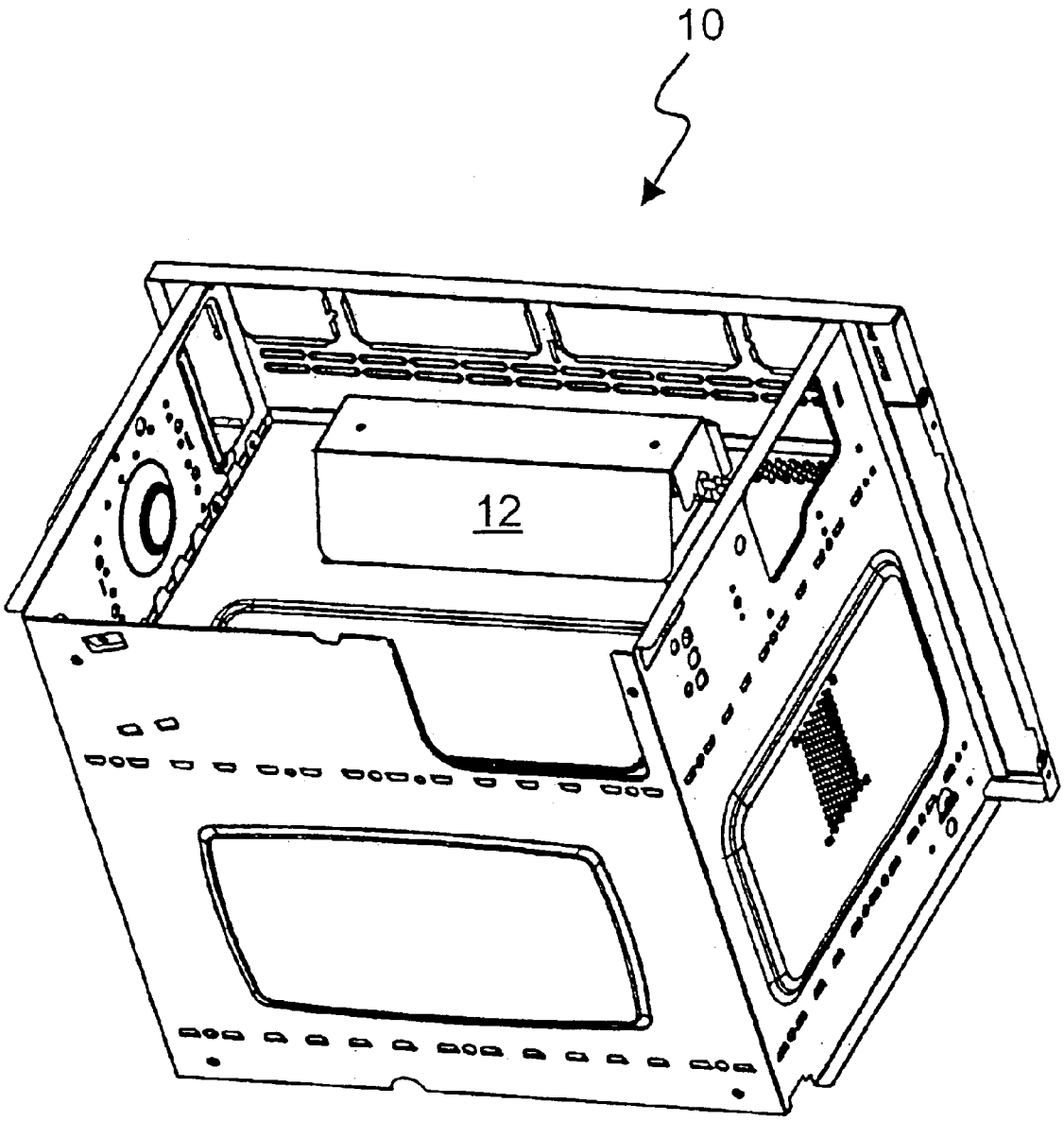
FIG. 1 schematically shows the interior of a microwave oven equipped with a browning device according to the present invention.

The present invention is based on the recognition that reflection of infrared radiation towards the oven cavity can be replaced by secondary emission of infrared radiation from a heated surface. Furthermore, it is recognized that this secondary emission can be achieved from a surface that is heated to a temperature at which splashes and particles from foodstuff in the oven cavity are vaporized or ignited. Preferably, the temperature of the heated surface is about 500° C. or higher, such that soot is removed. Notably, soot is ignited at a temperature slightly below 500° C.

In order to achieve said secondary emission of infrared radiation, and at the same time induce automatic removal of soot and other contaminations, the interior surface of the hollow space (in which the grill element is arranged) should have IR-absorbing properties thus forming a screen (rather than a reflector). Moreover, the surface of the hollow space (the screen) should be thermally insulated from the surroundings outside the cavity in order for the desired temperature to be reached. In other words, instead of a reflector as in the prior art, an infrared absorbing screen is used above or behind the grilling element.

In a microwave oven according to the present invention, the browning device is arranged in a hollow space, much like in above-mentioned EP 0 956 739. However, the interior surface of said hollow space is not made reflecting for infrared radiation. In contrast, the interior surface is comprised of an infrared absorbing material forming a screen. This screen has two primary functions, namely to emit secondary infrared radiation at a wavelength different from that emitted by the browning device directly; and to reach during operation of the browning device an elevated temperature at which dirt and soot are automatically vaporized or combusted from the surface, thus providing a self-cleaning effect. In particular, the temperature of the screen is raised to about or above 500° C. by absorption of infrared radiation from the grill device. At such temperatures, soot is vaporized or combusted and hence removed. This gives a screen behind the grilling element that is always clean and aesthetically appealing to the user.

The grilling element can be comprised of any suitable infrared radiating means. It is preferred, however, that the grilling element is a quartz tube heater giving a power of at least 300 W.

As will be described in more detail below, it is also conceivable, and sometimes preferred, that the space in which the grilling element is arranged is actually a part of the microwave cavity. In other words, this space need not be microwave-free.

The screen to be heated can be coated by a layer of ceramic material such as $Al_2O_3$ coated onto a base substrate. This material is advantageous, since it provides the desired functionality and is readily available at a low price. Conveniently, the layer is deposited onto the interior of the hollow space by flame spraying. However, the coating could also be comprised of enamel or a suitable ceramic paint coated onto a base substrate.

The hollow space is preferably formed by an insert that is attached to the ceiling of the oven cavity. To this end, an opening is made in the top cavity wall (the ceiling) and the insert is rigidly attached at this opening. The insert can be made from the same material as the cavity walls, such as stainless steel. However, if the interior surface (the screen) is uncoated, the material must have the ability to absorb IR-radiation from the grill element and to obtain and sustain a temperature of about 500° C. for an extended period of time.

In order to prevent excess thermal load of the microwave oven and to promote the temperature rise of the IR-absorbing screen, the insert contains and/or is surrounded by a thermally insulating material such as mineral wool or fiber insulating material. Good thermal insulation is important for obtaining a fast response time for the secondary emission of infrared radiation from the screen, and for reaching the self-cleaning temperature.

Furthermore, in order to reduce conduction of heat from the insert to the rest of the cavity walls, the insert is preferable perforated at its edges.

A further effect of the layer of infrared absorbing material on the interior surface of the hollow space is to protect the wall material from tempering and oxidation. A fully covering layer of, for example, $Al_2O_3$ will prevent oxygen from reaching the metal, and hence provides an efficient protection.

When the interior surface is uncoated, the insert is preferably pre-treated in a heating chamber, in order for it to obtain uniform color and uniform absorption properties.

Typically, the grilling element will have a temperature of about 1000° C. during operation corresponding to a peak emission wavelength of about 2.3 $\mu$m, and the interior surface of the hollow space (i.e. the screen) will have a temperature of about 500° C. corresponding to a peak emission wavelength of about 3.7 $\mu$m. By making use of two different wavelengths, an improved browning effect can be obtained for the foodstuff placed in the oven cavity.

Preferably, the shape of the screen is formed such that the secondary emission is prevented from reaching the oven door, the reason being to prevent excess heating thereof and to minimize the risk that the user gets burned when operating the oven. The screen is shaped in order to direct the secondary emission towards a load zone in the cavity for maximum radiation on the foodstuff placed there. Also, the shape of the screen is preferably such that direct radiation from the radiating tube (the grilling element) is prevented from reaching the oven door for the same reasons as above.

The hollow space of the insert can accommodate more than one grilling element, such as two elements. This allows the emitted IR-radiation to be more confined to the load zone in the oven cavity. Also, multiple elements in a single space gives a better grilling effect for a given total power of the elements.

The interior of a microwave oven 10 according to the present invention is shown in FIG. 1 from the back. The oven comprises a microwave cavity defined by cavity walls and an oven door, and a browning device 12 is provided in the ceiling of the cavity. As can be seen from the figure, the browning device 12 has the form of a bulge or hollow space with two substantially vertical side gables, a steep side closest to the oven door, and a slanting side closest to the back of the microwave cavity. This shape of the bulge or space is chosen in such way that infrared radiation from the browning device is prevented from directly hitting the oven door.

Figure 2:
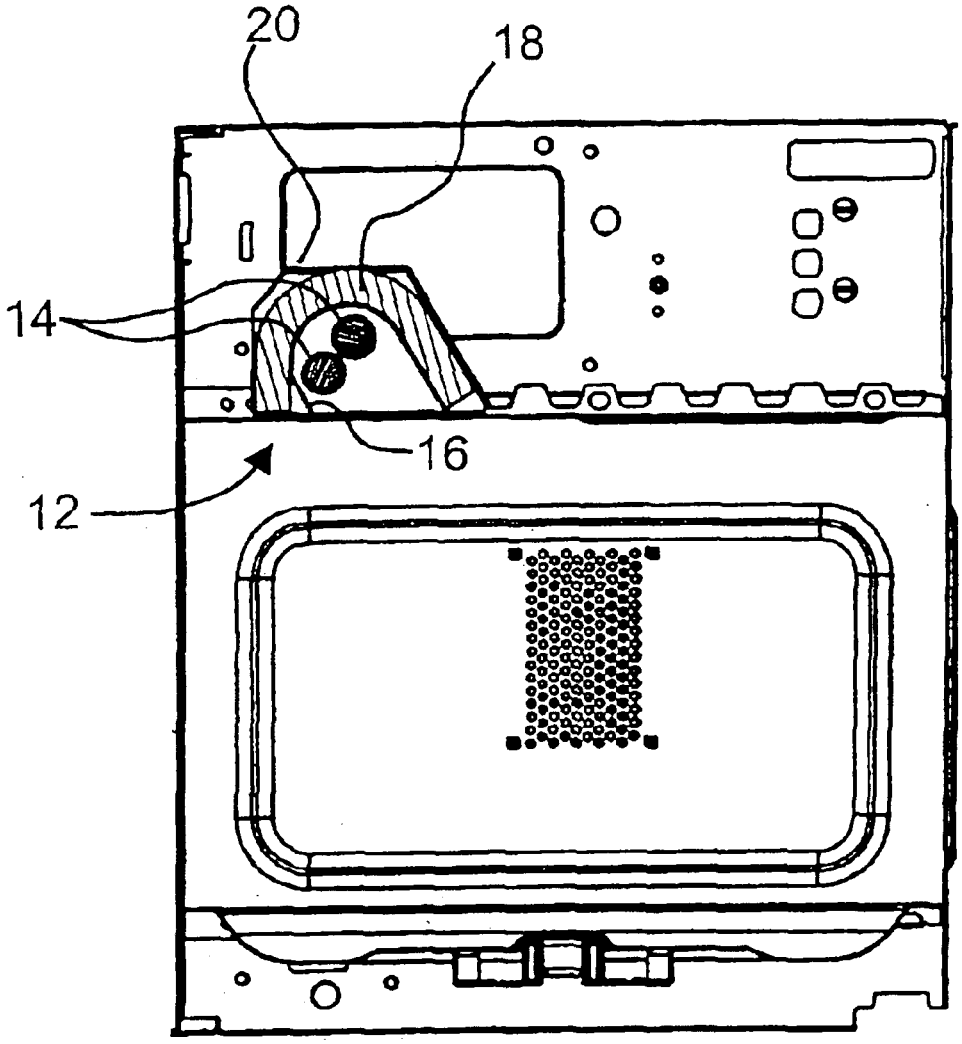
FIG. 2 schematically shows a side view of the microwave oven of FIG. 1.

FIG. 2 shows a side cross section of the microwave oven 10 of FIG. 1, illustrating the shape and placement of the browning device 12 in more detail. In FIG. 2, the oven door is situated to the left, and the back of the microwave cavity is depicted at the right. The browning device 12 as shown in FIG. 2 comprises two quartz tubes 14 arranged parallel to each other in the hollow space. The space is defined by an infrared absorbing screen 16. As mentioned above, the shape of the screen 16 is such that infrared radiation from the quartz tubes 14 is prevented from directly hitting the oven door. The screen is made from sheet metal, and may be coated with an IR-absorbing material. If the sheet metal is IR-absorbing in itself, the screen may be left uncoated. Outside the screen 16, on the side away from the microwave cavity, there is provided an insulating layer 18 of mineral wool, fiber insulating material or the like. The main purpose of this insulating layer is to enhance the temperature rise of the screen 16 due to absorption of radiation from the quartz tubes 14, such that the temperature of the screen reaches 500° C. or higher. At a temperature slightly below 500° C., soot (carbon) is ignited, leading to a self-cleaning performance for the screen once that temperature has been exceeded. Furthermore, the screen 16 will emit secondary radiation at a wavelength different from that emitted directly from the quartz tubes 14, leading to a possible increase in browning efficiency. Outside the insulating layer 18, there is provided a protecting sheet 20.

Figure 3:
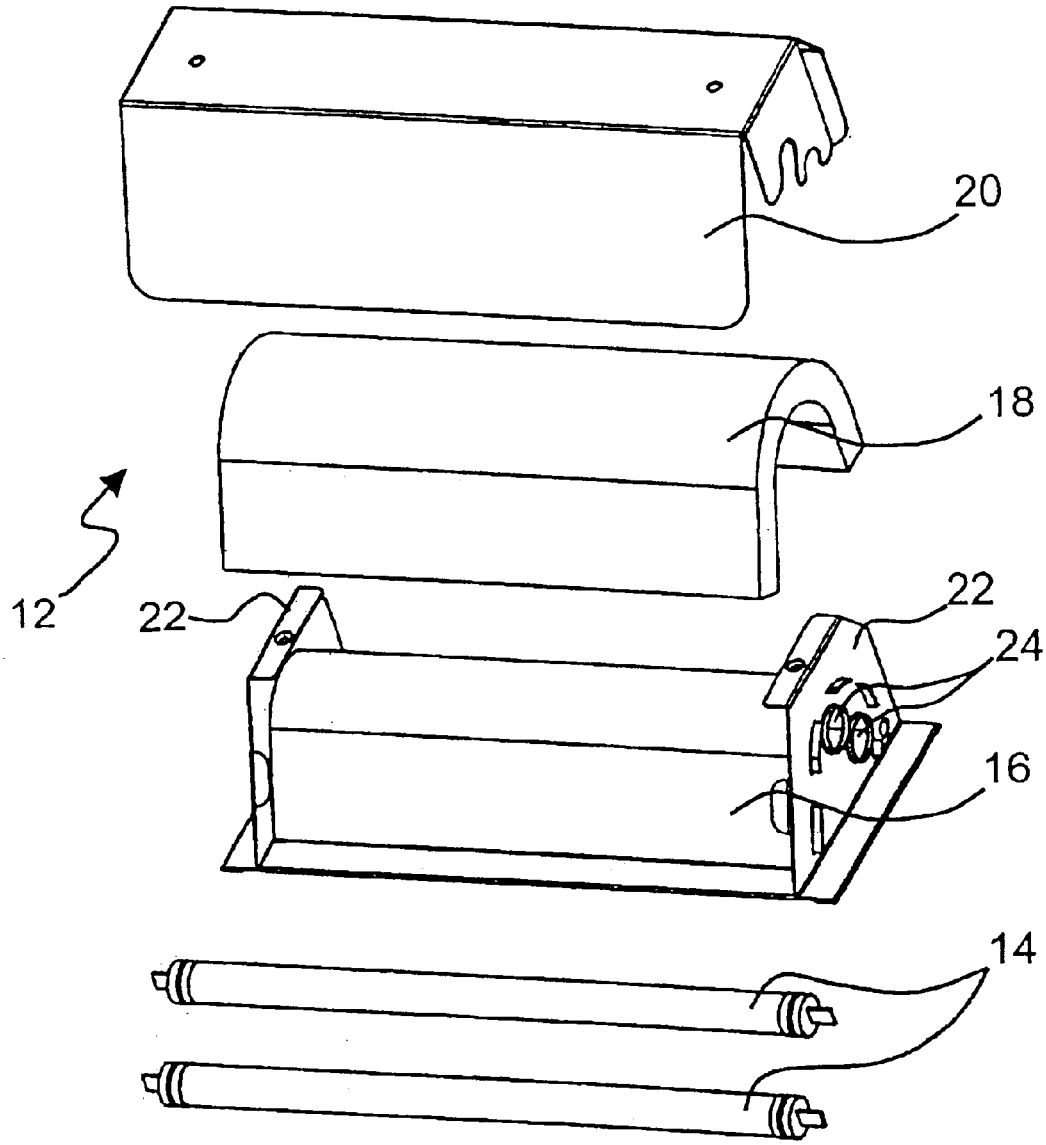
FIG. 3 is an exploded view of a browning device insert according to the invention.

The entire browning device 12 is preferably made in the form of an insert. In FIG. 3, such insert is shown in some detail. The insert comprises a screen 16 made from bent sheet metal, held between two side walls or gables 22. Openings 24 are formed in the gables 22 to house the infrared generators or grilling elements 14, such as a pair of quartz tubes as described above. Outside the screen, the insulating layer 18 is placed. Conveniently, the gables 22 are wider than the profile of the bent sheet metal forming the screen 16, in order for the insulation 18 to fit within the perimeters of the gables. Finally, an outer protective sheet 20 is arranged around the insulation 18 and attached to the gables 22. The entire insert is then mounted in an opening in a wall of the microwave cavity, preferably the roof.

The hollow space of the browning device can be made with a shape such that the space is essentially free from microwaves during operation of the oven. However, this is not always necessary. When using grilling elements in the form of quartz tubes, for example, microwaves can be allowed to fully enter into the browning device. The reason for this is that the quartz tubes are comprised of a tube containing a spiral wire. The spiral shape leads to the wire acting as an inductive coil, having extremely low conduction of microwave energy along the coil. Hence, as long as the spiral shape continues to the outside of the cavity (past the gables 22), no microwaves will leak out. In other words, there is no linear conductor that can act as an antenna for the microwaves.

Figure 4A:
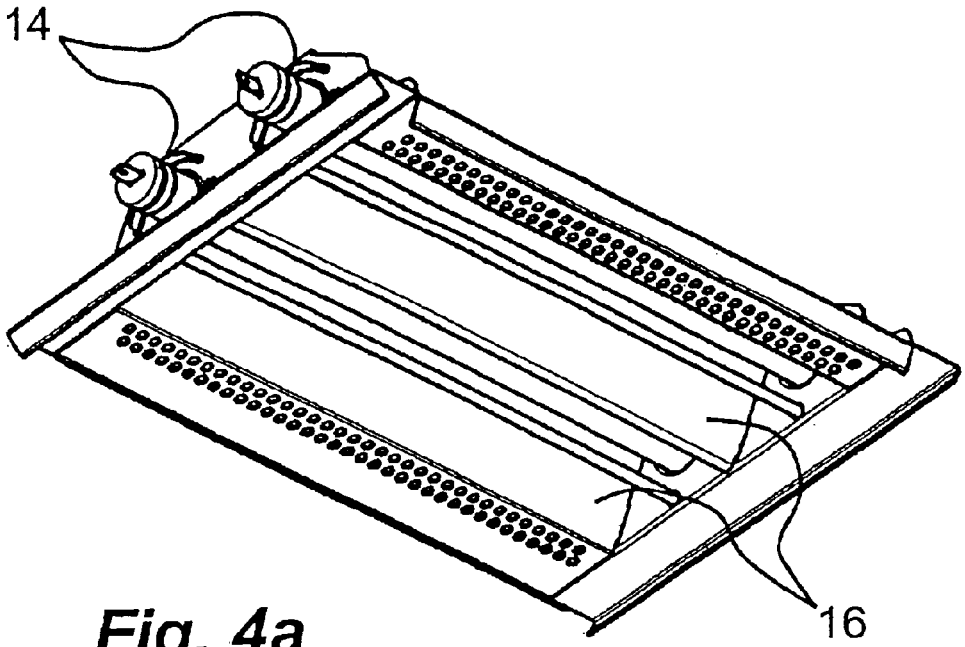
FIGS. 4*a* and 4*b* schematically show perspective views from below and from above, respectively, of another embodiment of a browning device insert according to the present invention.
Figure 4B:
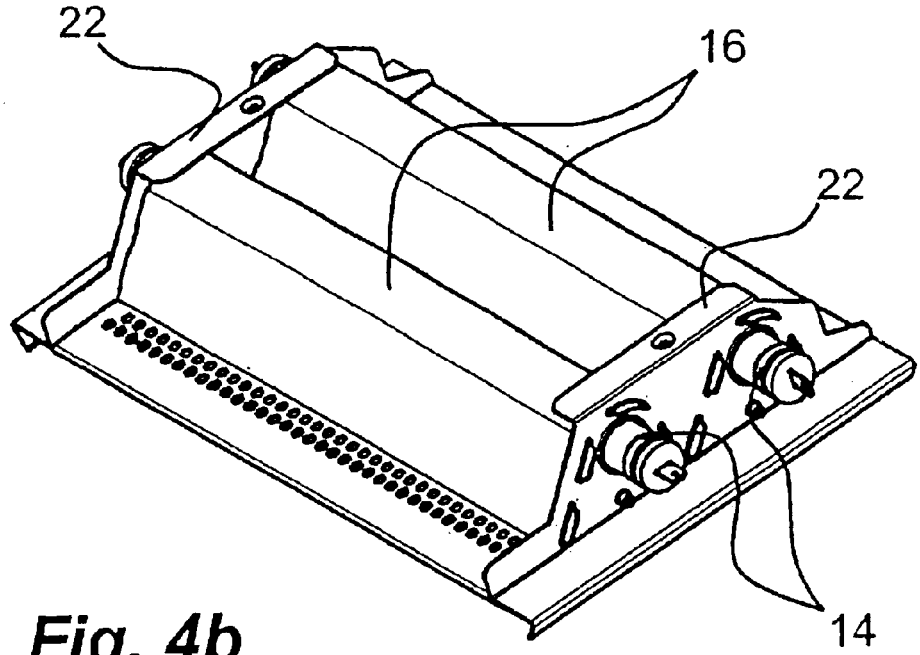

Another type of browning device insert is shown in FIGS. 4*a* and 4*b*. In this case, the insert comprises two hollow spaces, each containing one quartz tube 14. The insert is formed by an undulated screen 16 of bent sheet metal and two side gables 22. Insulation and outer protection (not shown in FIG. 4) are also provided, as in the previous case. From FIGS. 4*a* and 4*b*, it is clearly seen how the grilling elements 14 (the quartz tubes) extend beyond the gables 22, giving a microwave sealing effect as described above.

Preferably, the browning device insert is perforated along its edges, as shown in FIGS. 4*a* and 4*b*, in order to reduce conduction of heat from the insert to the cavity wall in which the insert is mounted. Although not shown in FIG. 3, perforations are preferably provided also in the case of dual or multiple grilling elements in a common space.

Figure 5:
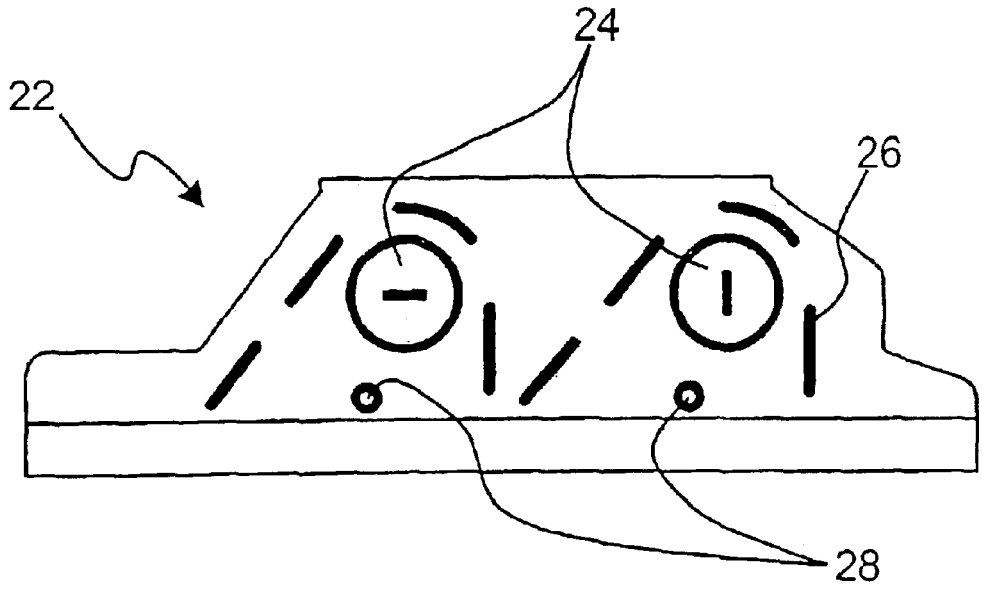
FIG. 5 is a plan view of a gable for the insert shown in FIGS. 4*a* and 4*b*.

FIG. 5 shows a side gable 22 having circular openings 24 for housing the grilling elements. In the shown embodiment, the gable is made for a browning device insert having two hollow spaces with one grilling element each. However, the gables are similarly designed for the case when two grilling elements are arranged in a common hollow space. In the gable, there are slits in which the screen is to be mounted. One of these slits is shown at 26. The slits 26 are positioned such that the screen adopts a shape which reduces the amount of radiation hitting the oven door. This is obtained by the screen having a steeper edge on the side closest to the door (to the right in FIG. 5). The edge of the screen on the side away from the door, the edge is more slant such that radiation from the grilling device (both direct radiation from the grilling elements, and secondary radiation from the screen) is primarily directed towards the load zone in the oven cavity. Adjacent to the lower edge of the gable, there are provided small openings 28 which are arranged to hold a mechanically protective element. Such element is preferably provided in order to eliminate the risk of mechanical damage to the grilling elements, or that a user inadvertently comes in contact with the hot grilling elements.

Figure 6:
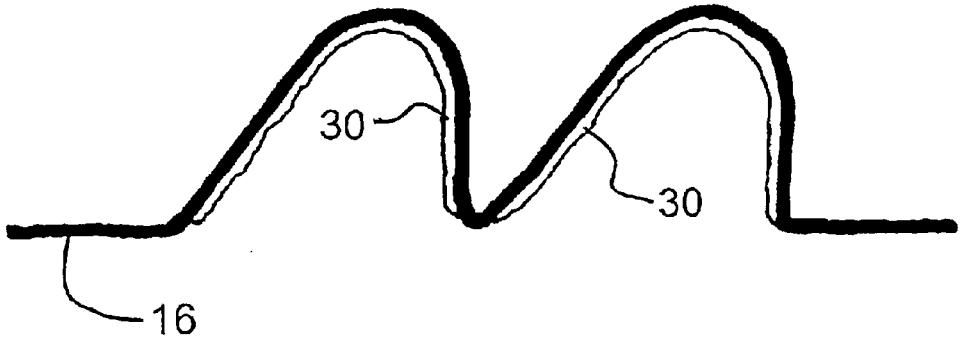
FIG. 6 schematically shows how a coating is applied to the screen of the browning device of FIGS. 4*a* and 4*b*.

FIG. 6 schematically shows a screen 16 provided with an IR-absorbing layer or coating 30 on its inner surface. As described above, the coating 30 can be omitted if the screen itself is IR-absorbing. Typically, the coating 30 is uniformly provided on the screen 16 at least in the hollow space housing the grilling elements. Depending on the material of the screen, the provision of a coating can lead to improved performance with respect to the self-cleaning effect according to the present invention. In addition, such coating may provide a more pleasing visual appearance of the browning device.

The present invention has been described above with reference to specific embodiments and to the accompanying drawings. It is nevertheless understood that the teachings of this specification can be applied also for other cases without departing from the scope of the invention as defined in the appended claims.

We claim:

1. A browning device in a microwave oven, the browning device comprising:

an infrared absorbing screen for absorbing infrared emissions from an infrared generator, wherein the infrared absorbing screen is held between a plurality of side walls;

the infrared absorbing screen and the plurality of side walls define a hollow space;

an insulation layer at least partially surrounding the infrared absorbing screen; and an outer wall arranged around the insulation layer and attached to the side walls.

2. The browning device of claim 1, wherein the infrared absorbing screen is constructed for repeated operation at a temperature of at least 500° C.

3. The browning device of claim 2, wherein the infrared absorbing screen is comprised of uncoated sheet metal.

4. The browning device of claim 2, wherein the infrared absorbing screen is coated with $Al_2O_3$.

5. The browning device of claim 1, wherein the infrared absorbing screen is coated with enamel.

6. The browning device of claim 1, wherein the infrared absorbing screen is constructed to obtain and sustain a temperature of at least 500° C. for an extended period of time.

7. A browning device mounted in an opening in a wall of a microwave cavity, the browning device comprising:

an infrared absorbing screen held between a plurality of side walls, wherein the infrared absorbing screen and the plurality of side walls define a hollow space;

an infrared generator at least partially arranged in the hollow space;

an insulation layer at least partially surrounding the infrared absorbing screen; and an outer wall arranged around the insulation layer and attached to the side walls.

8. The browning device of claim 7, wherein the infrared absorbing screen is constructed to repeatedly obtain and sustain a temperature of at least 500° C.

9. The browning device of claim 8, wherein the infrared absorbing screen is comprised of uncoated sheet metal.

10. The browning device of claim 8, wherein the infrared absorbing screen is coated with $Al_2O_3$.

11. The browning device of claim 7, wherein the infrared absorbing screen is coated with enamel.

12. The browning device of claim 7, wherein the infrared generator is comprised of two quartz tubes.

13. The browning device of claim 7, wherein the plurality of side walls further include a plurality of slits for engagement with the infrared absorbing screen.

14. A browning device in a microwave oven, the browning device comprising:

an undulated infrared absorbing screen held between a plurality of side walls, wherein the undulated infrared absorbing screen and the plurality of side walls define a first hollow space, and a second hollow space;

a first infrared generator at least partially arranged in the first hollow space;

a second infrared generator at least partially arranged in the second hollow space;

an insulation layer at least partially surrounding the undulated infrared absorbing screen; and an outer wall arranged around the insulation layer and attached to the side walls.

15. The browning device of claim 14, wherein the undulated infrared absorbing screen is coated with $Al_2O_3$.

16. The browning device of claim 14, wherein the plurality of side walls further include a plurality of slits for engagement with the undulated absorbing screen.

17. The browning device of claim 14, wherein the infrared absorbing screen is constructed to repeatedly obtain and sustain a temperature of at least 500° C.

18. The browning device of claim 17, wherein the plurality of side walls further include a plurality of slits for engagement with the undulated absorbing screen.

19. The browning device of claim 18, wherein the first and second infrared generators are comprised of quartz tubes.

20. The browning device of claim 19, wherein the undulated absorbing screen is coated with enamel.

* * * * *